US012509283B2

(12) United States Patent
Trombley et al.

(10) Patent No.: US 12,509,283 B2
(45) Date of Patent: Dec. 30, 2025

(54) CAP OF A PACKAGE SUITABLE FOR STORING PERSONAL HEALTH CARE PRODUCTS

(71) Applicant: The Procter & Gamble Company, Cincinnati, OH (US)

(72) Inventors: Kurt Franklin Trombley, Loveland, OH (US); Peter Leonard Middleton, Cincinnati, OH (US); Susan Eleanor Baillely, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 302 days.

(21) Appl. No.: 18/121,789

(22) Filed: Mar. 15, 2023

(65) Prior Publication Data

US 2023/0294887 A1 Sep. 21, 2023

(30) Foreign Application Priority Data

Mar. 17, 2022 (EP) ..... 22162693

(51) Int. Cl.
*B65D 51/24* (2006.01)
*B65D 47/08* (2006.01)

(52) U.S. Cl.
CPC ..... *B65D 51/245* (2013.01); *B65D 47/088* (2013.01); *B65D 51/249* (2013.01)

(58) Field of Classification Search
CPC .. B65D 51/245; B65D 47/088; B65D 51/249; B65D 47/00; B65D 35/44; B65D 2203/00; B65D 2203/12
USPC ..... 215/230
See application file for complete search history.

(56) References Cited

U.S. PATENT DOCUMENTS

| | | | | |
|---|---|---|---|---|
| 2,913,140 | A | 11/1959 | Vuillemenot | |
| 3,413,743 | A | 12/1968 | Goodhue | |
| 3,730,399 | A * | 5/1973 | Dibrell | B65D 47/2018 222/518 |
| 4,111,322 | A * | 9/1978 | Obrist | B65D 41/02 215/230 |
| 4,190,180 | A | 2/1980 | Bennet | |
| D276,118 | S | 10/1984 | Swett | |
| D290,326 | S | 6/1987 | Daenen et al. | |
| 4,674,640 | A | 6/1987 | Asa | |

(Continued)

FOREIGN PATENT DOCUMENTS

| | | | |
|---|---|---|---|
| CN | 105947381 | A | 9/2016 |
| CN | 106144175 | A | 11/2016 |

(Continued)

OTHER PUBLICATIONS

All Office Actions; U.S. Appl. No. 18/121,773, filed Mar. 15, 2023.

(Continued)

*Primary Examiner* — Ernesto A Grano
(74) *Attorney, Agent, or Firm* — John G. Powell; Elizabeth A. Conklin

(57) ABSTRACT

A cap of a package is suitable to store and present personal health care products. The cap of the package disclosed herein comprises an information for a receiver which corresponds to the personal health care product and which is recognizable with visual and tactile senses. The information is transferred by a product specific icon which protrudes from an external surface of the cap of the package.

25 Claims, 3 Drawing Sheets

(56) References Cited

U.S. PATENT DOCUMENTS 4,747,501 A 5/1988 Greaves
4,993,569 A * 2/1991 Osip ..... B65D 51/224 215/250
5,127,553 A * 7/1992 Weinstein ..... G01F 11/288 222/207
6,000,159 A * 12/1999 Hornung ..... G09F 11/23 215/230
6,024,234 A * 2/2000 Rink ..... B65D 51/223 215/250
6,227,371 B1 * 5/2001 Song ..... G09B 21/003 215/230
7,083,058 B2 * 8/2006 Perry ..... B65D 51/223 215/351
7,419,072 B1 * 9/2008 Vanella ..... B65D 23/001 222/113
D677,568 S * 3/2013 Sina ..... D7/392.1
8,424,711 B2 * 4/2013 Charbonnet ..... B65D 43/0208 220/717
8,708,189 B2 * 4/2014 Reitzig ..... B65D 47/127 220/730
9,114,916 B2 * 8/2015 Knipe ..... B65D 43/0212
D770,280 S * 11/2016 Katopis ..... D9/451
D770,893 S * 11/2016 Katopis ..... D9/451
D771,493 S * 11/2016 Katopis ..... D9/601
D773,932 S * 12/2016 Katopis ..... D9/451
9,546,018 B1 * 1/2017 Vovan ..... B65D 43/0254
9,820,594 B2 * 11/2017 Bower ..... A47G 19/2261
10,065,773 B2 * 9/2018 Seidler ..... B65D 47/0823
10,232,993 B2 * 3/2019 Seiders ..... A47G 19/2272
D850,260 S * 6/2019 Eickhoff ..... D9/454
10,405,680 B2 * 9/2019 Mithal ..... A47G 19/2211
10,433,664 B2 * 10/2019 Brannock ..... B65D 51/16
D867,826 S * 11/2019 Shah ..... D7/630
10,781,012 B2 * 9/2020 Bratsch ..... B65D 47/286
10,954,039 B1 3/2021 Iversen et al.
D993,770 S * 8/2023 Eickhoff ..... D9/454
11,760,545 B1 * 9/2023 Wade ..... B65D 50/041 215/238
2004/0149675 A1 8/2004 Perry et al.
2005/0051574 A1 3/2005 Kesselman
2005/0236442 A1 * 10/2005 Kratzer ..... B65D 47/088 222/566
2010/0072099 A1 * 3/2010 Klein ..... B65D 51/20 426/87
2010/0072613 A1 3/2010 Walberg
2011/0155732 A1 * 6/2011 Sprunger ..... B65D 47/06 220/694
2012/0181278 A1 * 7/2012 Pagan ..... B65D 47/244 220/288
2012/0318697 A1 * 12/2012 Stern ..... B65D 21/0233 206/514
2013/0004940 A1 * 1/2013 Hu ..... A61B 10/0096 436/95
2013/0119059 A1 * 5/2013 Toh ..... B65D 51/245 220/203.11
2015/0375904 A1 12/2015 Goddard et al.
2016/0264325 A1 * 9/2016 Ruggiero Ruggieri ..... B65D 55/066
2016/0345762 A1 * 12/2016 Brannock ..... B65D 43/0212
2017/0043913 A1 * 2/2017 Strachan ..... B65D 1/40
2017/0158389 A1 * 6/2017 Lavelock ..... B65D 51/248
2017/0312174 A1 * 11/2017 Azuma ..... B65D 47/18
2018/0029742 A1 2/2018 Hynell et al.
2018/0222246 A1 * 8/2018 Martin ..... B43L 1/008
2018/0327147 A1 * 11/2018 Santini ..... B65D 41/0492
2018/0327149 A1 * 11/2018 Abdiye ..... B65D 47/246
2018/0339819 A1 * 11/2018 Stodd ..... B65D 43/0202
2018/0370685 A1 * 12/2018 Wagner ..... B65D 81/38
2019/0084730 A1 * 3/2019 Li ..... B65D 81/366
2020/0407124 A1 * 12/2020 Caszatt ..... B65D 47/0838
2021/0139204 A1 * 5/2021 Bitzaya ..... B65D 43/0214
2021/0269204 A1 * 9/2021 LaBrecque ..... B65D 51/245
2022/0041341 A1 * 2/2022 Eickhoff ..... B29C 48/022
2022/0142872 A1 * 5/2022 Ayari ..... B65D 23/001
2022/0250805 A1 * 8/2022 Minnette ..... B65D 41/3438
2023/0105117 A1 * 4/2023 Waterman ..... B29C 49/42412 264/603
2023/0365318 A1 * 11/2023 Zammori ..... B65D 47/06
2024/0252397 A1 * 8/2024 Gong ..... B65D 41/06
2024/0391660 A1 * 11/2024 Purdy ..... B65D 47/06

FOREIGN PATENT DOCUMENTS

CN 110203536 A 9/2019
DE 19543227 A1 5/1997
DE 20221447 U1 2/2006
FR 3047474 A1 8/2017
GB 911556 A 11/1962
WO 2015198160 A2 12/2015

OTHER PUBLICATIONS

Extended EP Search Report and Written Opinion for 22162693.0 dated Sep. 9, 2022, 07 pages.
U.S. Appl. No. 18/121,773, filed Mar. 15, 2023, to Kurt Franklin Trombley et al.
PCT Search Report and Written Opinion for PCT/US2023/064357 dated Jul. 5, 2023; 12 pages.

* cited by examiner

CAP OF A PACKAGE SUITABLE FOR STORING PERSONAL HEALTH CARE PRODUCTS

FIELD OF THE INVENTION

The present invention relates to a cap of a package, wherein the package is suitable to contain, store and present personal health care products, such as personal health care compositions, for example oral care compositions. The cap of the package disclosed herein comprises and provides information for the receiver and consumer which corresponds to the personal health care product, and which is recognizable with visual and tactile senses.

BACKGROUND OF THE INVENTION

Personal health care products are stored and presented to the consumer in neutral packages, which usually do not identify the product included therein by the package per se. Information to be transferred to the receiver and/or consumer are mostly printed on the surface of the packages, thereby identifying the product contained in the package as well as information about composition, storage information, intended use, dosage, etc. Transferring the included information only by printing on the packages exclude people from said information which are unable to understand the used langue, people who have reading problems and/or people who are visually impaired. Personal or electronic assistance, for example from translators or reading aids, may overcome said problem but is not suitable for any situation of daily live. Further, independence and autonomy are important parameters for a contended life. Accordingly, packages are needed comprising means for transferring the intended information easily and clearly without the need of visual senses or understanding of language or letters. Therefore, it is the object of the present invention to provide packages or parts thereof which transfer at least basic information about the products contained therein without the use of lettering.

SUMMARY OF THE INVENTION

The present invention relates to a cap of a package suitable to contain a personal health care composition comprising at least one external surface, wherein the external surface comprises a circumferential edge, a first protrusion located inside, for example centrally arranged in, said circumferential edge and a second protrusion protruding from said first protrusion; wherein the sum of a first height of the first protrusion and of a second height of the second protrusion is equal or smaller than a height of the circumferential edge; and wherein the maximal height of the second protrusion is at least about 0.4 mm and wherein the shape of the second protrusion is recognizable by a human being and has a shape of an icon. Said icon may represent a class of goods, such as a toothpaste or a toothbrush, or may be a brand icon, or a combination thereof.

The present invention further relates to a package comprising said cap as disclosed herein.

The present invention is further directed to a method of transferring information to a human being, for example to a human being who is visually impaired, comprising:

Filling a content such as a personal health care composition, for example an oral care composition, into a package;

Identifying an icon representative for the content contained in said package;

Providing a cap of said package comprising said icon, for example providing a cap as disclosed herein, wherein the icon is the second protrusion;

Combining the cap and the package; and

Providing the package to the human being so that the icon is detectable, for example detectable by tactile senses.

The present invention further relates to a process for making the oral care article as disclosed herein; the process comprising injection molding of the cap as disclosed herein.

DETAILED DESCRIPTION OF THE INVENTION

Figure 1A:
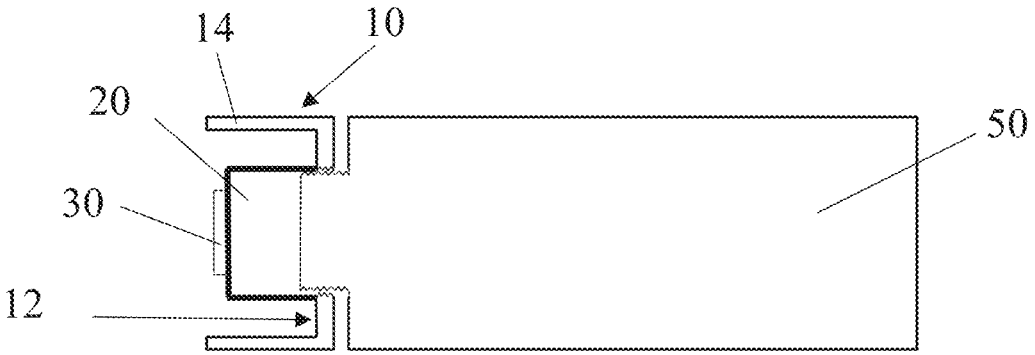
FIG. 1A shows a cross sectional view of an embodiment of a tube being a package 50 having a cap 10 as disclosed herein and comprising a first protrusion 20 and a second protrusion 30 in shape of an icon.

It has been found that basic information about a product can be transferred to the receiver, e.g. the consumer, beside the language and printings. Icons which unambiguously represent one product or product group may be a suitable alternative for categorizing a product. Further, these icons will be not only viewable but also be recognizable by tactile sense if they protrude from the external package surface.

The term "personal health care composition" as used herein refers to any composition for use in personal health care, including but not limited to compositions needed for daily hygiene, such as cleaning compositions, toothpastes, cremes, hair shampoo or compositions for well-being, such as dietary supplements.

The term "oral care composition" as used herein refers to a composition for use in the oral hygiene, for example in the mouth. In the ordinary course of usage, an oral care composition is not intentionally swallowed for purposes of systemic administration of particular therapeutic agents, rather it is retained in the oral cavity for a time sufficient to contact dental surfaces or oral tissues. Examples of oral care compositions as used herein include dentifrice, tooth gel, subgingival gel, mousse, foam, denture care products, or denture adhesive products.

The term "dentifrice", as used herein, includes tooth or subgingival-paste, or gel formulations unless otherwise specified. The dentifrice composition may be a single-phase composition or may be a combination of two or more separate dentifrice compositions. The dentifrice composition may be in any desired form, such as deep striped, surface striped, multilayered, having a gel surrounding a paste, or any combination thereof. Each dentifrice composition in a dentifrice comprising two or more separate dentifrice compositions may be contained in a physically separated compartment of a dispenser and dispensed side-by-side.

The term "package suitable to contain a personal health care composition" as used herein refers to any form of a container made from any material resistant and protective to the personal health care composition to be stored therein. Suitable forms may be cans, vessels or tubes, for example made from plastic material.

The term "plastic material" or "plastic(s)" as used herein refers to any synthetic or organic materials that can be molded or shaped, generally when heated, and then hardened into a desired form including, but not limited to, polymers, resins, and cellulose derivatives.

The term "plastic package" as used herein refers to the container being made substantially of plastic. The sealing means, such as caps, covers, or lids of the package may or may not necessarily be made substantially of plastic, wherein the package and the sealing means may be from the same or different plastics.

The term "renewable material" as used herein means the material has been derived from a renewable resource (i.e., something that can be restored and replenished by nature in a period of time that is compatible with human use).

The term "icon" as used herein means a symbol which is easily and clearly identifiable by visual and tactile senses and which is unambiguously assigned to a product or a product group.

The term "tactile senses" as used herein means any recognition of an object or surface by contact to the skin, including but not limited to the skin of the fingers, for example the skin of the fingertips.

The term "external surface" as used herein means that the surface does not stay in direct contact with the composition present in the package. Accordingly, an "external surface" as used herein usually stays in direct contact with the environment.

As used herein, the word "or" when used as a connector of two or more elements is meant to include the elements individually and in combination; for example, X or Y, means X or Y or both.

As used herein, the articles "a" and "an" are understood to mean one or more of the article that is claimed or described, for example, "an personal health care composition" or "a part of a package."

As used herein, the word "include," and its variants, are intended to be non-limiting, such that recitation of items in a list is not to the exclusion of other like items that may also be useful in the materials, topical compositions, devices, and methods of this invention.

As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the invention.

Package and Package Cap as Part Thereof

The packages as disclosed herein are suitable to contain a personal health care composition. The present invention can be realized with any kind, form or type of the package as long as the personal health care composition is securely stored therein, protected from environmental influences and can be taken therefrom by the consumer easily. A suitable example package comprises any kind of a container, a can, a vessel, a dose, a tube, or any other package suitable for the intended use. A tube may be suitable for substantially semisolids, such as creamy or pasty compositions which can be easily dispensed therefrom. The package as disclosed herein comprises at least one part comprising at least one protrusion in shape of an icon comprising the information to be transferred. Said part may be separable from the package or may be an inseparable part of the package. Suitable separable or inseparable parts according to the present invention are caps. A suitable separable or inseparable cap may be a closure, a cap, a cover, or a combination thereof. As the cap of the package shall transfer information to the consumer caps may be preferred which, even if they are separable, are usually stored together with the package and not removed when first used. The cap may be a foldable cap or an integral cap. A foldable cap may comprise a static part and a foldable part connected to each other with a hinge. The folding line between the static and the folding part may be parallel to the external surface of the cap or may be inclined. In foldable caps the base of the static part may comprise a through-hole suitable to receive a nozzle of the package. Integral caps may be connected to the package via a thread. The cap may be separable or inseparable from the package and may be of any form such as circular, oval, irregular, angular or any other form which is able to close a tube and comprises at least one external surface suitable to carry at least one protrusion comprising the information to be transferred as disclosed herein. A suitable external surface of a cap of a tube may be the top surface of the cap. Said top surface may be for example circular having a diameter in the range of from about 20 mm to about 50 mm, or a diameter from about 35 mm to about 45 mm or a diameter from about 30 mm to about 40 mm, or a diameter about 35 mm or any other numerical range which is narrower, and which falls within such broader numerical range, as if such narrower numerical ranges were all expressly written herein. A diameter within the disclosed ranges may be advantageous allowing that the tube can be securely stood on said surface but is not too big to be easily handled by the consumer.

External Surface to Carry the Protrusions

The external surface according to the present invention which carries the at least one protrusion comprising the information to be transferred also comprises a circumferential edge, wherein the form of the edge depends on the form of the external surface. For example, a circular or oval surface may have one continuous circumferential edge in circular or ovel form. An angled surface may have one circumferential edge comprising different sites, wherein the number of the sites is equal to the number of the angles the surface comprises. Circular or oval forms may also be combined with angular sites of the surface which carries the protrusions. The circumferential edge shows a height measured from the external surface. A suitable height of the edge may be from about 2 mm to about 25 mm, or from about 2 mm to about 20 mm, or from about 2 mm to about 15 mm, or any other numerical range which is narrower, and which falls within such broader numerical range, as if such narrower numerical ranges were all expressly written herein. An example edge may be small just suitable to cover the protrusions disclosed herein; for example, the height of said edge may be from about 2 mm to about 5 mm, or the height of the edge may be from about 2 mm to about 4 mm, or the height of the edge may be from about 2 mm to about 3 mm, or any other numerical range which is narrower and which falls within such broader numerical range, as if such narrower numerical ranges were all expressly written herein. Small edges are easy to produce by injection molding and show advantages for manufacturing accordingly. Alternatively, an example edge may be large forming the outer shape of the cap of the package disclosed herein; for example, the height of said edge may be from about 5 mm to about 20 mm, or the height of the edge may be from about 6 mm to about 15 mm, or the height of the edge may be from about 8 mm to about 12 mm, or any other numerical range which is narrower and which falls within such broader numerical range, as if such narrower numerical ranges were all expressly written herein. Large edges are advantages for sustainability reasons as forming the outer shape just by thin edges reduces the overall amount of material, e.g., plastic needed.

The circumferential edge may be arranged vertical to the surface, or it may show an inclination angle. For example, the edge may be leaned outwards, a suitable angle for the edge may be from about 1° to about 10°, or from about 2° to about 8°, or from about 3° to about 5°, or any other numerical range which is narrower and which falls within such broader numerical range, as if such narrower numerical ranges were all expressly written herein measured to a vertically arranged edge.

The circumferential edge may comprise a flat surface so that the cap and the package can stand on the circumferential edge in a top-down position. Therefore, the wall thickness of the edge needs to be thick enough to carry the weight of the package including the composition in top-down position. For example the width of the circumferential edge may be in the range of from about 0.5 mm to about 5 mm, or in the range of from about 0.5 mm to about 3 mm, or in the range of from about 1.0 mm to about 2.0 mm or any other numerical range which is narrower and which falls within such broader numerical range, as if such narrower numerical ranges were all expressly written herein.

The external surface further comprises a first protrusion inside the one or more edge(s). The first protrusion shows a height measured from the surface and a suitable height of the first protrusion may be from about 2 mm to about 19.5 mm, or from about 2 mm to about 14.5 mm, or any other numerical range which is narrower, and which falls within such broader numerical range, as if such narrower numerical ranges were all expressly written herein. An example first protrusion may be small just suitable to carry the second protrusion disclosed herein; for example, the height of these first protrusion may be from about 2 mm to about 4.5 mm, or the height of the first protrusion may be from about 2 mm to about 4 mm, or the height of the first protrusion may be from about 2 mm to about 3 mm, or any other numerical range which is narrower and which falls within such broader numerical range, as if such narrower numerical ranges were all expressly written herein. A small first protrusion is easy to produce by injection molding and show advantages for manufacturing accordingly. Alternatively, an example first protrusion may be large imitating the outer shape of the edge in a smaller range; for example, the height of these first protrusion may be from about 5 mm to about 14.5 mm, or the height of the first protrusion may be from about 6 mm to about 12 mm, or the height of the first protrusion may be from about 8 mm to about 10 mm, or any other numerical range which is narrower and which falls within such broader numerical range, as if such narrower numerical ranges were all expressly written herein. A large first protrusion, for example one imitating the outer shape of the one or more edge(s) is advantages for sustainability reasons as the overall amount of material, e.g., plastic material will be reduced, if the intended shape is formed in a smaller range. Further, the wall thickness of the plastic material can be further reduced as shapes formed in a W-style show higher mechanical stability even with smaller wall thickness. The first protrusion as disclosed herein is variable in radius or form but at least suitable to carry the second protrusion which comprises the information as disclosed herein.

Several embodiments are disclosed combining several combinations of the circumferential edge and the first protrusion, wherein, the shape and size of the edge and the first protrusion are highly variable and are adapted to the packages as long as the height of the edge is equal or larger than the sum of the height of the first protrusion and the height of the second protrusion comprising the information. Thus, the second protrusion protruding from the first protrusion which protrudes from the external surface does not project over the circumferential edge of the external surface but forms at least a plane with said edge. An embodiment wherein the sum of the heights of the first and second protrusion and the height of the edge are equal may be advantageous for arranging the package standing on the edge as the second protrusion would increase the contact area. Alternatively, the height of the edge may be larger than the sum of the heights of first and second protrusion protruding from the external surface. An embodiment wherein the height of the edge is larger than the sum of the heights of first and second protrusion may be advantageous for shielding the second protrusion from the direct influence of the environment.

Protrusion Comprising the Information

The cap of the package as disclosed herein further comprises a protrusion comprising the information to be transferred. Said protrusion may protrude from the first protrusion disclosed herein so that the protrusion comprising the information represents a second protrusion. Said second protrusion may be of any form but comprises a shape which is recognizable or can be learned by a human being as an icon. For example, shapes may be chosen which represent an icon representing a class of goods or products, or an individual product. Example for suitable icons according to the present invention are an icon representing a toothpaste or a dentifrice, an icon representing a toothbrush, an icon representing washing hands, an icon representing a hair-cut, an icon representing a shower head, or an icon comprising a brand, or a combination thereof. In one embodiment the cap of the present invention will comprise an icon representing a product for oral care, such as a dentifrice or toothpaste.

The size of the second protrusion in form of an icon, is chosen so that the shape is recognizable by visual and tactile senses. A suitable size may be an icon being recognizable by one tactile contact. One tactile contact means that one does not need to follow the outline of the icon sequentially but can recognize the icon by placing the finger or fingertips on it including small movements only. For example, the second protrusion icon may have a shape comprising a length in the range of from about 10 mm to about 25 mm, or a length in the range of from about 12 mm to about 20 mm, a length in the range of from about 14 mm to about 18 mm, a length in the range of from about 15.5 mm to about 16.5 mm, or the length may be about 16 mm or any other numerical range which is narrower and which falls within such broader numerical range, as if such narrower numerical ranges were all expressly written herein. The protrusion icon may have a shape also comprising a width in the range of from about 3 mm to about 15 mm, or a width in the range of from about 4 mm to about 8 mm, a width in the range of from about 6 mm to about 7 mm, or the width may be about 6.85 mm or any other numerical range which is narrower and which falls within such broader numerical range, as if such narrower numerical ranges were all expressly written herein.

The icon as disclosed herein is provided as a second protrusion having a height compared to the surface of the first protrusion. The second protrusion itself may have a flat surface or an irregular surface, for example the surface of the second protrusion may be curved. For example, the surface of the second protrusion may be curved in a curve corresponding to the curve of the surface the second protrusion protrudes from, or the second protrusion may be curved in a curve different to the curve of the surface the protrusion protrudes from, or a combination thereof. Suitable surfaces of the second protrusion as disclosed herein are a flat surface, a surface parallel to the surface the protrusion protrudes from, an irregular surface wherein the height of the second protrusion varies along the protrusion. In addition or alternatively, the surface of the protrusion may be textured. "Texture" as used herein means any structural difference to a smooth surface which might be regular or irregular. Regular texture may be suitable to mark the protrusion as a continuous icon. Suitable textures may be the textures according to VDI 3400 standard texture #38 to #48, or the textures according to VDI 3400 standard texture #40 to #46, or the textures according to VDI 3400 standard texture #40 to #44, or the texture according to VDI 3400 standard texture #42. For example, the surface of the protrusion may comprise a texture, or a different texture compared to the first protrusion of the surface of the cap. A difference in the surface of the protrusion forming the icon to any other surfaces may increase the recognition by tactile senses. For example, a textured surface of the icon protrusion protruding from a homogeneous smooth and non-textured first protrusion surface may let the icon feel larger and easier to distinguish.

Independent from the surface of the second protrusion, i.e. flat, curved, irregular shaped, the height disclosed herein is the maximal height of the second protrusion measured to the surface of the first protrusion. Further, the maximal height is limited by the height of the edges so that the second protrusion comprising the information will never break the virtual flat plane at the level of the edges. In addition, the second protrusion comprising the information shall be recognizable also by tactile senses so that a minimum value for the maximal height is needed which is about 0.4 mm A suitable maximal height of a second protrusion comprising the information according to the present invention may be from about 0.4 mm to about 2 mm, or a maximal height of a second protrusion may be from about 0.4 mm to about 1.5 mm, or a maximal height of a second protrusion may be from about 0.4 mm to about 1.0 mm, or a maximal height of a second protrusion may be from about 0.45 mm to about 0.8 mm or a maximal height of a second protrusion may be from about 0.5 mm to about 0.6 mm, or a maximal height of a second protrusion may be about 0.5 mm or any other numerical range which is narrower and which falls within such broader numerical range, as if such narrower numerical ranges were all expressly written herein. A maximal height within the given ranges will be advantageous as shrinking effects occurring by injection molding do not make a secure issue and the second protrusion is still recognizable by tactile senses. Accordingly, the minimal height of the second protrusion is at least about 0.25 mm as 0.2 mm are hardly recognizable by tactile senses and the contour of the second protrusion shall not smear and become unclear by optional variation in height.

In addition, an injection molding port may be present inside the perimeter of the second protrusion due to manufacturing requirements. Generally, it will be advantageous to locate the injection molding port outside the perimeter of the second protrusion in order to provide the whole perimeter of the second protrusion for tactile recognition. If production requirements arrange the injection molding port inside the perimeter of the second protrusion, it will be designed as small as possible and not exceeding height or outline of the second protrusion so that the icon can be clearly identified by tactile senses. Further, sharp features should be avoided generally in order not to distract the attention of the user from the icon itself or even harm the user.

The second protrusion comprising the information as disclosed herein is intended to be recognizable also by tactile senses. For a smooth tactile feeling the edges of the shape contour may be not too sharp to be uncomfortable to be touched or may not be too smooth to be hardly recognizable by the tactile sense. A suitable corner radius of the edge of the shape contour of the second protrusion comprising the information may be less than about 10 mm, or the corner radius may be less than about 4 mm, or the corner radius may be less than about 1 mm, or any other numerical range which is narrower and which falls within such broader numerical limits, as if such narrower numerical limits were all expressly written herein.

Plastic Materials

The package as well as the cap comprising the first and second protrusions may be made from plastic material. Plastic materials that are suitable according to the present invention are capable of containing and being exposed to a high variety of health care compositions and compounds and show high impact resistance, chemical resistance and thermal stability. The package may be made from one or more plastic materials and may also optionally include additional polymer materials, colorants, fillers and/or additives to impart desirable aesthetics, mechanical, or functional properties. Suitable plastic materials are thermoplastic materials, for example a polyolefin, a polyester, a polycarbonate, a polyamide, or a combination thereof.

Polyolefins are the plastic materials mostly used worldwide. Polyethylene (PE) can be divided into several groups based on the density wherein high-density polyethylene may be preferred herein showing a high tensile strength. Polypropylene (PP) which is slightly harder than PE may also be used for the packages as disclosed herein showing a high chemical resistance and being also available as bio-based renewable material.

Plastic materials that may be also useful in the present invention include, polyesters, polyester copolymers, and mixtures thereof. Polyesters may be selected from the group consisting of polyethylene terephthalate (PET), polyester copolymers and mixtures thereof. Polyester copolymers are for example selected from the group consisting of polyethylene terephthalate glycol-modified (PETG), polycyclohexanedimethanol terephthalate (PCT), polycyclohexanedimethanol terephthalate isophthalate (PCTA), polycyclohexanedimethanol terephthalate glycol (PCTG), and mixtures thereof. The polyester copolymers for example comprise monomers selected from the group consisting of isophthalic acid (IPA), terephthalic acid (TPA), butane diol (BD), cyclohexanedimethanol (CHDM), ethylene glycol (EG), diethylene glycol (DEG) and mixtures thereof.

Polycarbonates (PC), polycarbonate copolymers, and mixtures thereof may be also useful as material for the packages of the present invention. Although PCs are generally known in the art to have bad chemical tolerance and/or resistance, chemical and heat resistance of PCs will be increased, if it is used as blend material. For example, a container formed from PC will rapidly haze and even crack if doused e.g., with ethanol for just a few seconds. However, e.g., blended with polyethylene terephthalate (PET) or PET copolymers at levels up to about 40% provides a material with chemical resistance similar to the PET material alone. Alternatively, Bisphenol A functional groups can be linked together by carbonate groups to form a polymer chain producing a thermoplastic material which is highly transparent to visible light, has excellent mechanical properties, and has very good thermal resistance.

Further plastic material useful for the packages of the present invention may be polyvinylchloride, polyvinylchloride polystyrene, polyvinylidene chloride, ethylene vinyl alcohol, polymethylmethacrylate, acrylonitrile butadiene styrene, polyethylene 2,5-furandicarboxylate (PEF), or a combination thereof. For example, PEF, particularly monolayer PEF, is more resistant to caustic solutions such as peroxide which can cause hydrolytic cracking or crazing produced by flavor compounds, such as limonene. Using PEF in a multilayer package, for example as inside material in the multilayer structure, may ensure higher crazing resistance in the areas under tensile stress.

At least one cap of the package of the present invention in any of the aspects can optionally include a colorant masterbatch, which can optionally turn the material, e.g., the plastic opaque. As used herein, a "colorant masterbatch" refers to a mixture in which pigments are dispersed or dyes are dissolved, at high concentration, in a carrier material. The colorant masterbatch is used to impart color to the final product. For example, the carrier may be a bio-based plastic or a petroleum-based plastic, or a bio-based oil or a petroleum-based oil. The colorant masterbatch can be derived wholly or partly from a petroleum resource, wholly or partly from a renewable resource, or wholly or partly from a recycled resource. Nonlimiting examples of the carrier include bio-derived or oil derived polyethylene (e.g., linear low-density polyethylene (LLDPE), low-density polyethylene (LDPE), high-density polyethylene (HDPE)), bio-derived oil (e.g., olive oil, rapeseed oil, peanut oil, soybean oil, or hydrogenated plant-derived oils), petroleum-derived oil, recycled oil, bio-derived or petroleum derived polyethylene terephthalate, polypropylene, and a mixture thereof. The pigment within the carrier, which can be derived from either a renewable resource or a non-renewable resource, can include, for example, an inorganic pigment, an organic pigment or dye, a polymeric resin, or a mixture thereof. Nonlimiting examples of pigments include titanium dioxide (e.g., rutile, anatase), copper phthalocyanine, antimony oxide, zinc oxide, calcium carbonate, fumed silica, phthalocyamine (e.g., phthalocyamine blue), ultramarine blue, cobalt blue, monoazo pigments, diazo pigments, acid dye, base dye, quinacridone, and/or a mixture thereof. The colorant masterbatch may further include one or more additives, which can either be derived from a renewable resource or a non-renewable resource. Nonlimiting examples of additives include slip agents, UV absorbers, nucleating agents, UV stabilizers, heat stabilizers, clarifying agents, fillers, brighteners, process aids, perfumes, flavors, foaming agents, supercritical carbon dioxide, nitrogen, and/or a mixture thereof.

Generally, color can be imparted to the plastic used for the packages of the present invention in any of the aspects by using direct compounding (i.e., in-line compounding). In these embodiments, a twin screw compounder is placed at the beginning of the injection molding, blow molding, or film line and additives, such as pigments, are blended into the resin just before article formation. Additional materials may be incorporated into the plastic used for the packages of the present invention in any of the aspects to improve the strength or other physical characteristics of the plastic. Such additional materials include an inorganic salt, such as calcium carbonate, calcium sulfate, talcs, clays (e.g., nanoclays), aluminum hydroxide, $CaSiCO_3$, glassfibers, glass spheres, crystalline silicas (e.g., quartz, crystallobite), magnesium hydroxide, mica, sodium sulfate, lithopone, magnesium carbonate, iron oxide, or a mixture thereof.

A suitable wall thickness for the packages of the present invention is at least about 0.65 mm, at least about 1.0 mm, at least about 1.30 mm, at least about 1.95 mm, at least about 2.60 mm, or about 3.25 mm and the final package may be of various shapes.

The cap of the package comprising the protrusions as disclosed herein may be made from the same material than the packages itself or a different material. Suitable materials for the cap of the package comprising the protrusions are the plastic materials as disclosed herein, in particular those which can be processed by injection molding as the protrusions may be preferably formed together with the cap carrying it, for example by one-step injection molding. A suitable wall thickness for the cap of the present invention is at least about 0.65 mm, at least about 1.0 mm, at least about 1.30 mm, at least about 1.95 mm, at least about 2.60 mm, or about 3.25 mm. The wall thickness of the cap and the package may be identical or different.

Personal Health Care Composition

Any personal health care composition can be used together with the packages as disclosed herein. Personal health care compositions may be preferred which belong to a product category which can be easily and unambiguously identified by a symbol or icon. The icon may be specific to one country or group of human beings or may be used regionally or world-wide. Example compositions may be for example hair care compositions, such as shampoo, conditioner, deep conditioner, smoothing compositions, or brilliance compositions, or compositions used for daily cleaning routine, such as liquid soap, shower compositions, oral care compositions, such as dentifrices, toothpastes, tooth gels, fluoride gels or any other creamy, pasty, or gelatinous compositions which is normally taken from a package as disclosed herein.

Method of Using the Package

The package as disclosed herein comprising the cap comprising the external surface carrying at least one protrusion can be used to transfer an information to a human being. The protrusion comprising the information may be shaped in a form representing an icon which corresponds to a product or product group. For example, a nurdle of toothpaste may be used as an icon to identify a dentifrice or any other composition suitable for tooth cleaning. In addition, or alternatively, a protrusion in the form of a hair style may be used to identify a hair shampoo or hair conditioning composition. Accordingly, the method as disclosed herein comprises the steps of:

- Filling a content into a package, wherein said content may be a personal health care product, such as an oral care product, such as a dentifrice;
- Identifying an icon representative for the package contents, wherein the icon shall be easily recognizable and unambiguously correlated the content of the package;
- Providing a cap of said package suitable to present the icon on an external surface in form of a protrusion;
- Combining the cap comprising the icon and the package; and
- Providing the package to the human being so that the icon is detectable and can be identified by the human being.

Using the package as disclosed herein comprising the external surface comprising the icon as a protrusion comprising the information the content of the package is identifiable without the use of language or letters. Accordingly, the information about the content of the package is transferred to all humans being able to identify the icon including but not limited to those which do not understand the language of the country wherein the package is used, have reading problems or are visually impaired.

EXAMPLES

The following non-limiting examples shown in FIGS. 1 to 5 further describe example embodiments of caps of packages within the scope of the present invention. Many variations of the examples are possible without departing from the scope of the invention.

FIG. 1A shows a cross sectional view of an embodiment of a package 50 having a cap 10 as disclosed herein. The package 50 shown in FIG. 1A is a tube having a cap 10 according to the present invention. The cap 10 comprises an external circular top surface 12 showing a first protrusion 20 protruding from the middle of the external surface 12 and a second protrusion 30 protruding from the middle of the first protrusion 20. A circumferential edge 14 protruding also from the external surface 12 forms the outer shape of the cap 10. The tube 50 can be made of any material suitable for packages storing health care products, such as polypropylene (PP), high density polyethylene (HDPE), or ethylene vinyl alcohol (EVOH) with an optional internal barrier layer made e.g., from aluminum. The cap 10 can be made from the same or different plastic material than the tube 50. A suitable material for the cap 10 comprising the first and second protrusions 20, 30 is polypropylene or high-density polyethylene being hard enough to form a second protrusion 30 which is clearly recognizable also for tactile senses.

Figure 1B:
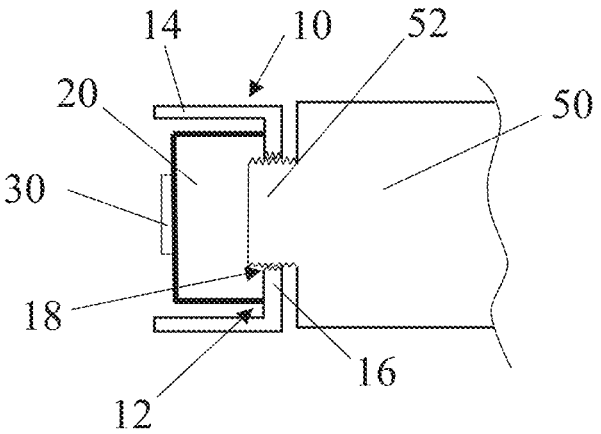
FIG. 1B shows a cross sectional view of an embodiment, wherein a nozzle 52 of the tube 50 passes through a through-hole 18 in the base 16 of the cap 10.

FIG. 1B shows a cross sectional view of another embodiment of a package 50 having an alternative cap 10 as disclosed herein. The cap 10 comprises a circular external top surface 12 showing a first protrusion 20 protruding from the middle of the external surface 12 and a second protrusion 30 protruding from the middle of the first protrusion 20. A circumferential edge 14 protruding also from the external surface 12 forms the outer shape of the cap 10. Further, a base 16 of the cap 10 comprises a through-hole 18 suitable to hold a nozzle 52 of the package 50. The tube 50 can be made of any material suitable for packages storing health care products, such as polypropylene (PP), high density polyethylene (HDPE), or ethylene vinyl alcohol (EVOH) with an optional internal barrier layer made e.g., from aluminum. The cap 10 can be made from the same or different plastic material than the tube 50. A suitable material for the cap 10 comprising the first and second protrusions 20, 30 is polypropylene or high-density polyethylene being hard enough to form a second protrusion 30 which is clearly recognizable also for tactile senses.

Figure 2:
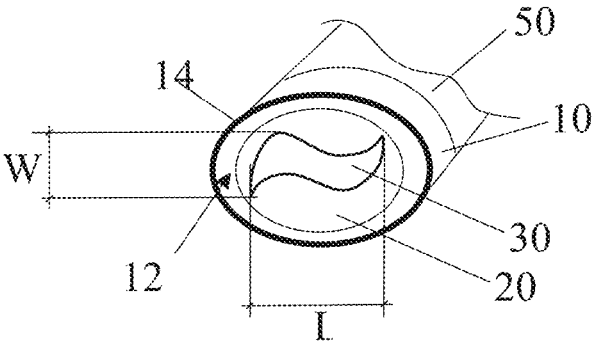
FIG. 2 shows a perspective view of an embodiment of the cap 10 having a second protrusion 30 in shape of an icon protruding from a first protrusion 20 protruding from the external surface 12.

FIG. 2 shows an embodiment of the cap 10 in a perspective view. The cap 10 carries the second protrusion 30 protruding from a first protrusion 20 protruding from the circular external surface 12 having a diameter of about 35 mm. The second protrusion 30 is placed in the middle of the first protrusion 20 which is placed in the middle of the circular external surface 12. The second protrusion 30 shows the form of a toothpaste nurdle suitable to be placed on a toothbrush head. The second protrusion 30 shown in FIG. 2 can be used as an icon for the product group of dentifrices and represents the toothpaste to be included into the package 50. The second protrusion 30 forms a S-line curved nurdle having a length L of about 16 mm and a width W of about 6.8 mm. The first protrusion 20, the second protrusion 30 and the cap 10 are made from the same material, e.g., polypropylene, using e.g., a one-step injection molding procedure.

Figure 3A:
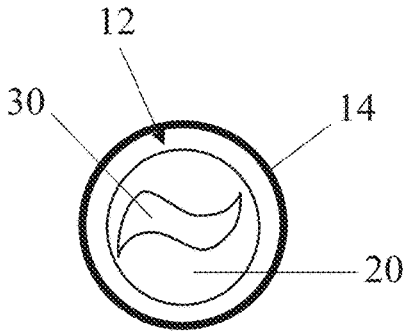
FIG. 3A shows a top view of an embodiment of the second protrusion 30 in form of a toothpaste nurdle.
Figure 3B:
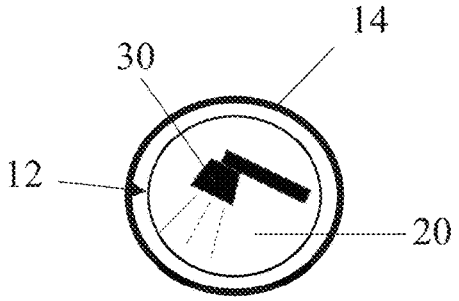
FIG. 3B shows a top view of an embodiment of the second protrusion 30 in form of a shower head.

FIG. 3 each show a top view of an embodiment of a circular cap 10, wherein a second protrusion 30 in form of an icon representative for a product category protrudes from a first protrusion 20 protruding from the circular external surface 12. FIG. 3A shows an icon in form of a toothpaste nurdle and FIG. 3B shows an icon in form of a shower head. A cap 10 having the second protrusion 30 in form of a toothpaste nurdle is suitable for packages containing toothpaste; and a cap 10 having the second protrusion 30 in form of a shower head is suitable for packages containing shower gel. Several other icons which unambiguously stand for one product or class of products can be alternatively used as second protrusion 30.

FIG. 4 each show a cross sectional view of different embodiments of the cap 10. In all embodiments the second protrusion 30 protrudes from a first protrusion 20 which protrudes from an external surface 12. The height H2 of the second protrusion 30 measured to the surface the first protrusion is about 0.5 mm, wherein the edge 34 of the protrusion 30 comprises a corner radius which is less than about 1 mm, for example about 0.4 mm. The height H1 of the first protrusion 20 and the height H3 as well as form and inclination of the edges 14 may vary according to the embodiment. The outer shape of the cap 10 is formed by the edge(s) 14.

Figure 4A:
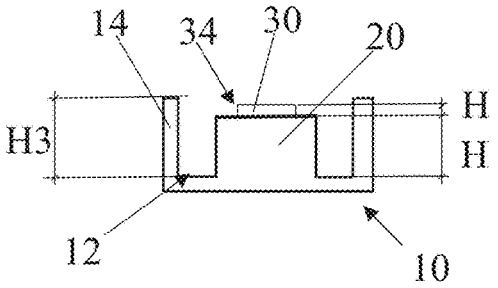
FIG. 4A shows a cross sectional view of an embodiment of the cap 10 having a second protrusion 30 protruding from a first protrusion 20, wherein the sum of a heights H1 and H2 of the first and second protrusion 20 and 30 is smaller than the height H3 of an edge 14 of the cap 10.

As can be seen in the embodiment shown in FIG. 4A the sum of the height H1 of the first protrusion 20 and the height H2 of the second protrusion 30 is smaller than the height H3 of the edge 14. Accordingly, first and second protrusion 20, 30 will be covered by the hollow created by the edge 14 protruding from the external surface 12. If the cap 10 is placed on the top surface the cap 10 will stand on the edge 14 of the external surface 12 and the second protrusion 30 won't have any contact to the ground. A suitable height H3 of the edges 14 is about 15 mm, and a suitable height H1 of the first protrusion 20 is about 10 mm.

Figure 4B:
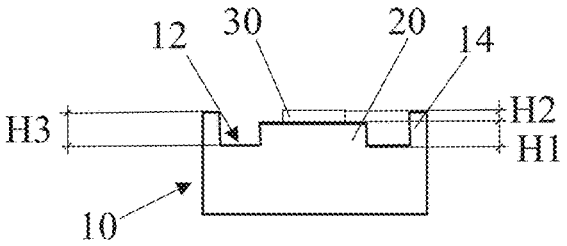
FIG. 4B shows a cross sectional view of an embodiment, wherein the sum of the heights H1 and H2 of the first and second protrusion 20 and 30 is equal to the height H3 of an edge 14 of the cap 10.

FIG. 4B shows an alternative embodiment of a cap 10 having an external surface 12 and a first and a second protrusion 20, 30 protruding therefrom. In the embodiment shown in FIG. 4B the sum of the height H1 of the first protrusion 20 and the height H2 of the second protrusion 30 is equal to the height H3 of the edge 14. Accordingly, the second protrusion 30 forms a plain with the edge 14 of the cap 10. If the cap 10 will be arranged to stand on the edge 14 the second protrusion 30 will also contact the ground. Further, the height H3 of the edge 14 is smaller compared to the embodiment shown in FIG. 4A. A suitable height H3 of the edge 14 shown in FIG. 4B is about 5 mm, and a suitable height H1 of the first protrusion 20 is about 4.5 mm.

Figure 4C:
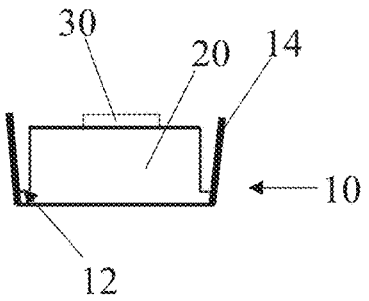
FIG. 4C shows a cross sectional view of an embodiment of the cap 10 having a second protrusion 30 protruding from a first protrusion 20, wherein the edge 14 of the cap 10 is leaned outwards.

FIG. 4C shows an additional embodiment of a cap 10 having an external surface 12 and a first and a second protrusion 20, 30 protruding therefrom. The circumferential edge 14 shown in FIG. 4C is leaning outwards with an inclination angle of about 3° measured to the vertical. An edge 14 leaning outwards as shown in FIG. 4C can be combined with smaller or higher edges 14 as shown in FIGS. 4A and 4B. The surface of the second protrusion 30 may be plane with or covered by the edge 14.

Figure 4D:
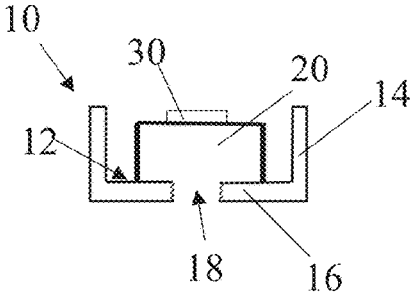
FIG. 4D shows a cross sectional view of an embodiment of the cap 10 having a having a second protrusion 30 protruding from a first protrusion 20, wherein a base 16 of the cap 10 comprises a through-hole 18.

FIG. 4D shows an additional embodiment of a cap 10 having an external surface 12 and a first and a second protrusion 20, 30 protruding therefrom. The base 16 of the cap 10 comprises a through-hole 18 suitable to hold a nozzle of a tube. Base 16 with and without a through-hole 18 can be combined with any height H3 and form of the edge 14 as disclosed herein.

FIG. 5 show additional embodiments of the present invention, wherein the cap 10 is folding cap. The folding line 17 may be parallel to the external surface 12 as shown in FIGS. 5A and 5B or the folding line 17 may be inclined to the external surface 12 as shown in FIGS. 5C and 5D.

Figure 5A:
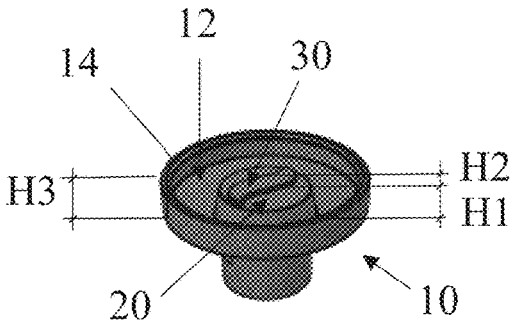
FIG. 5A shows a perspective view of foldable cap 10 of a present invention in closed state.
Figure 5B:
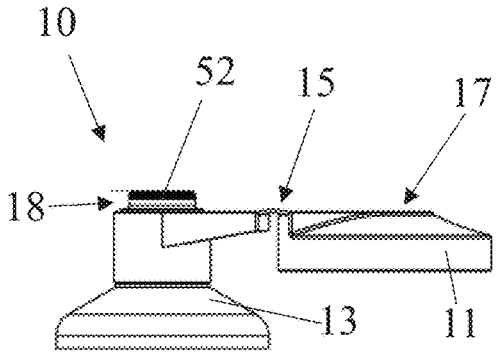
FIG. 5B shows a side view of the foldable cap 10 of FIG. 5A in open state, wherein the folding part 11 is fold open.

FIG. 5A shows a perspective view of a folding cap 10, wherein the circumferential edge 14 is small. The height H3 only comprises about 5.0 mm. In the middle of the surface 12 a first circular protrusion 20 is shown which carries the second protrusion 30 in form of a toothpaste nurdle which represents a suitable icon for a dentifrice. The diameter of the first protrusion is adapted to the length of the toothpaste nurdle being about 16 mm. The width of the nurdle is about 6 mm and the height H2 is about 0.4 mm. The height of the first protrusion 20 is about 4.6 mm. The folding cap 10 comprises a static lower part 11 and a foldable upper part 13. The folding line 17 is parallel compared to the surface 12 and the edge 14. FIG. 5B shows the folding cap 10 shown in FIG. 5A in an open state. The folding part 13 is folded away and connected with the static part 11 via the hinge 15. In open state a nozzle 52 from the tube can be seen reaching through a through-hole 18 in the base of the static part 11 of the foldable cap 10.

Figure 5C:
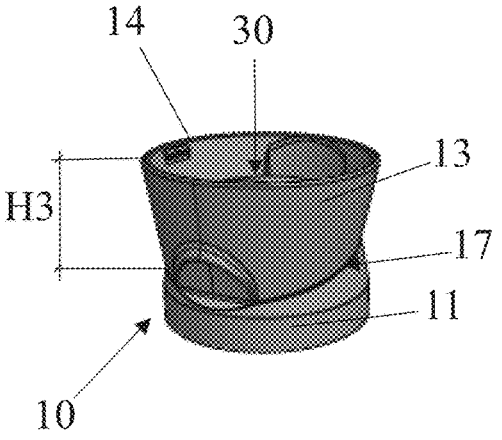
FIG. 5C shows a perspective view of another foldable cap 10 of a present invention having a inclined folding line 17.
Figure 5D:
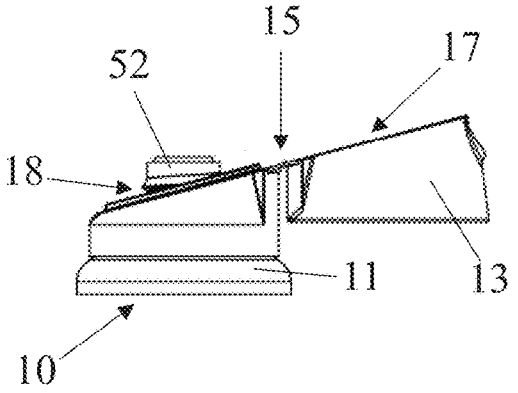
FIG. 5D shows side view of the foldable cap 10 of FIG. 5C in open state, wherein the folding part 11 is fold open.

FIG. 5C shows a perspective view of another folding cap 10, wherein the circumferential edge 14 is large. The height H3 of the edge comprises 20.0 mm. The second protrusion 30 is placed on a first protrusion in the middle of the surface 12. The folding cap 10 comprises a static lower part 11 and a foldable upper part 13. The folding line 17 is inclined compared to the surface 12 and the edge 14. FIG. 5D shows the folding cap 10 shown in FIG. 5B in an open state. The folding part 13 is folded away and connected via the hinge 15 with the static part 11. A nozzle 52 from the tube reaches through a through-hole 18 in the base of the static part 11 of the foldable cap 10.

Combinations

A. Cap of a package suitable to contain a personal health care composition comprising at least one external surface, wherein said external surface comprises a circumferential edge, a first protrusion located inside and for example centrally arranged in the circumferential edge and a second protrusion protruding from the first protrusion, wherein the sum of a first height of the first protrusion and a second height of the second protrusion is equal or smaller than a height of the circumferential edge; and wherein the height of the second protrusion is at least about 0.4 mm and wherein the second protrusion comprises a shape recognizable by a human being, wherein the shape may be an icon representing a class of goods.

B. The cap of the package according to paragraph A, wherein the height of the second protrusion is from about 0.4 mm to about 2 mm, or from about 0.4 mm to about 1.5 mm, or from about 0.4 mm to about 1.0 mm, or from about 0.45 mm to about 0.8 mm or from about 0.5 mm to about 0.6 mm, or about 0.5 mm C. The cap of the package according to paragraph A or B, wherein the height of the first protrusion is from about 2 mm to about 19.5 mm, or from about 2 mm to about 4.5 mm, or from about 5 mm to about 14.5 mm, or from about 2 mm to about 3 mm or from about 8 mm to about 10 mm D. The cap of a package according to anyone of paragraph A to C, wherein the shape is a toothpaste icon, a toothbrush icon, a brand icon, or a combination thereof.

E. The cap of a package according to anyone of paragraph A to D, wherein the size of the second protrusion is selected so that the shape is recognizable by tactile sense, e.g. by one tactile contact, or wherein the shape of the second protrusion comprises a length in the range of from about 10 mm to about 25 mm, or from about 12 mm to about 20 mm, or from about 14 mm to about 18 mm, or from about 15.5 mm to about 16.5 mm F. The cap of a package according to anyone of paragraph A to E, wherein the shape of the second protrusion comprises a width in the range of from about 3 mm to about 15 mm, or from about 4 mm to about 8 mm, or from about 6 mm to about 7 mm G. The cap of a package according to anyone of paragraph A to F, wherein the corner radius of the edge of the shape contour of the second protrusion is less than about 10 mm, or less than about 4 mm, or less than about 1 mm, or less than about 0.4 mm H. The cap of a package according to anyone of paragraph A to H, wherein the edge is leaned outwards, for example comprising an inclination angle from about 1° to about 10°, or from about 2° to about 8°, or from about 3° to about 5° measured to the vertical.

I. The cap of a package according to anyone of paragraph A to G, wherein the edge comprises a flat surface and a width in the range of from about 0.5 mm to about 5 mm, or in the range of from about 0.5 mm to about 3 mm, or in the range of from about 1.0 mm to about 2.0 mm J. The cap of a package according to anyone of paragraph A to I, wherein a base of the cap comprises a through-hole suitable to receive a nozzle of the package.

K. The cap of a package according to anyone of the paragraph A to J, wherein the cap is a folding cap comprising a folding part and a static part connected by a hinge and separated by a folding line, for example wherein the folding line is parallel or inclined to the external surface, or wherein the foldable part of the cap comprises at least the external surface and the first and second protrusion.

L. The cap of a package according to anyone of paragraph A to K, wherein the cap is an inseparable closure of the package, for example an inseparable closure of the tube.

M. The cap of a package according to anyone of paragraph A to L, wherein the cap comprises a plastic material, or a thermoplastic material, or a polyolefin, a polyester, a polycarbonate, a polyamide, or a combination thereof, or polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene or a combination thereof, or polypropylene, high density polyethylene, ethylene vinyl alcohol, or a combination thereof.

N. The cap of a package according to anyone of paragraph A to M, wherein the surface of the second protrusion is curved or flat.

O. The cap of a package according to anyone of paragraph A to N, wherein the surface of the protrusion is textured, for example wherein the surface of the protrusion is textured according to VDI 3400 standard texture in the range of from #38 to #48, or in the range of from #40 to #46, or in the range of from #40 to #44, or according to VDI 3400 standard texture #42.

P. Package comprising the cap of a package according to anyone of paragraph A to O, wherein the package is a tube.

Q. The package according to paragraph P, wherein the package is able to stand on the cap of the package, e.g. on the surface of the second protrusion and/or the circumferential edge.

R. The package according to paragraphs P or Q, wherein the package comprises a plastic material, or a thermoplastic material, or a polyolefin, a polyester, a polycarbonate, a polyamide, or a combination thereof, or polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene or a combination thereof, or polypropylene, high density polyethylene, ethylene vinyl alcohol, or a combination thereof.

S. Method of transferring information to a human being, e.g. to a human being is visually impaired comprising Filling a content, such as a personal health care composition into a package;

Identifying an icon representative for the content contained in the package;

Providing a cap for a package according to anyone of paragraphs A to O or a package according to anyone of paragraphs P to R, wherein the second protrusion is shaped as the icon identified in step before;

Combining the cap and the package; and

Providing the package to the human being so that the icon is detectable.

Values disclosed herein as ends of ranges are not to be understood as being strictly limited to the exact numerical values recited. Instead, unless otherwise specified, each numerical range is intended to mean both the recited values and any real numbers including integers within the range. For example, a range disclosed as "1 to 10" is intended to mean "1, 2, 3, 4, 5, 6, 7, 8, 9, and 10" and a range disclosed as "1 to 2" is intended to mean "1.1, 1.2, 1.3, 1.4, 1.5, 1.6, 1.7, 1.8, 1.9, and 2."

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A cap for a package suitable to contain a personal health care composition comprising at least one external surface, wherein the at least one external surface comprises a circumferential edge, a first protrusion located inside the circumferential edge, and a second protrusion protruding from the first protrusion, wherein a sum of a height of the first protrusion and of a height of the second protrusion is equal to or smaller than a height of the circumferential edge;

wherein a maximal height of the second protrusion is in a range of from about 0.4 mm to about 2.0 mm; and wherein a shape of the second protrusion comprises an icon representing a product selected from dentifrice, toothpaste, and toothbrush, wherein the icon comprises information about the product which can be transferred to a human.

2. The cap of claim 1, wherein the height of the second protrusion is from about 0.4 mm to about 1.0 mm.

3. The cap of claim 1, wherein the height of the first protrusion is from about 2 mm to about 19.5 mm.

4. The cap of claim 3, wherein the height of the first protrusion is from about 2 mm to about 3.0 mm.

5. The cap of claim 3, wherein the height of the first protrusion is from about 8 mm to about 12 mm.

6. The cap of claim 1, wherein a size of the second protrusion is selected so that the icon is recognizable by tactile sense comprising a length in a range of from about 10 mm to about 25 mm.

7. The cap of claim 6, wherein the second protrusion comprises a length in a range of from about 14 mm to about 18 mm.

8. The cap of claim 1, wherein the second protrusion comprises a width in a range of from about 3 mm to about 15 mm.

9. The cap of claim 8, wherein the width of the second protrusion is in a range of from about 6 mm to about 7 mm.

10. The cap of claim 1, wherein a corner radius of an edge of a shape contour of the second protrusion is less than about 4 mm.

11. The cap of claim 10, wherein the corner radius of the edge of the shape contour of the second protrusion is less than about 0.4 mm.

12. The cap of claim 1, wherein the circumferential edge is leaned outwards comprising an inclination angle from about 1° to about 10° measured to vertical.

13. The cap of claim 12, wherein the inclination angle is from about 3° to about 5° measured to vertical.

14. The cap of claim 1, wherein the circumferential edge comprises a flat surface and a width in a range of from about 0.5 mm to about 5 mm.

15. The cap of claim 14, wherein the width is in the range of from about 1.0 mm to about 2.0 mm.

16. The cap of claim 1, wherein a base of the cap comprises a through-hole suitable to receive a nozzle of a package.

17. The cap of claim 1, wherein the cap is a folding cap comprising a folding part and a static part connected by a hinge and separated by a folding line.

18. The cap of claim 17, wherein the folding line is parallel or inclined to the external surface.

19. The cap of claim 17, wherein the folding part of the cap comprises at least the external surface, the first protrusion, and the second protrusion.

20. The cap of claim 1, wherein the cap comprises a thermoplastic plastic material, comprising a polyethylene, high density polyethylene, polypropylene, polyethylene terephthalate, polyvinylchloride, polyvinylchloride polystyrene, polyvinylidene chloride, ethylene vinyl alcohol, polymethylmethacrylate, polyethylene 2,5-furandicarboxylate, acrylonitrile butadiene styrene, or a combination thereof.

21. A package comprising a cap comprising at least one external surface, wherein the at least one external surface comprises a circumferential edge, a first protrusion located inside the circumferential edge, and a second protrusion protruding from the first protrusion, wherein a sum of a height of the first protrusion and of a height of the second protrusion is equal to or smaller than a height of the circumferential edge; and wherein a maximal height of the second protrusion is in a range of from about 0.4 mm to about 2.0 mm; and wherein a shape of the second protrusion is recognizable by a human being and has a shape of an icon, and wherein the package is a tube.

22. Package of claim 21, wherein the package is able to stand on the cap.

23. The package of claim 22, wherein the package is able to stand on the circumferential edge alone, or on the circumferential edge and a surface of the second protrusion.

24. The package of claim 21, wherein the cap and the package are inseparably connected to each other.

25. A method of transferring information to a human being comprising:

(i) filling a personal health care composition into a package;

(ii) identifying an icon representative for the personal health care composition contained in the package, wherein the icon does not include lettering;

(iii) providing a folding cap comprising:

(a) at least one external surface, wherein the at least one external surface comprises a circumferential edge, a first protrusion located inside the circumferential edge, (b) a second protrusion protruding from the first protrusion, wherein a sum of a height of the first protrusion and of a height of the second protrusion is equal to or smaller than a height of the circumferential edge; and wherein a maximal height of the second protrusion is in a range of from about 0.4 mm to about 2.0 mm; and wherein a shape of the second protrusion is recognizable by a human being and is shaped as the icon identified in step (ii), (c) a folding part, and (d) a static part connected to the folding part by a hinge and separated by a folding line, wherein the folding part of the cap comprises at least the external surface, the first protrusion and the second protrusion, and;

(iv) combining the cap and the package; and (iv) providing the package to the human being so that the icon is detectable by tactile senses.

* * * * *